US008826927B1

(12) United States Patent
Beam et al.

(10) Patent No.: US 8,826,927 B1
(45) Date of Patent: Sep. 9, 2014

(54) BRUSH-IN APPARATUS FOR BLINDS

(75) Inventors: Keith Beam, New Glarus, WI (US); Scott D. Lee, Madison, MS (US)

(73) Assignee: Primos, Inc., Flora, MS (US)

( * ) Notice: Subject to any disclaimer, the term of this patent is extended or adjusted under 35 U.S.C. 154(b) by 27 days.

(21) Appl. No.: 13/160,206

(22) Filed: Jun. 14, 2011

(51) Int. Cl.
*E04H 15/32* (2006.01)
*E04H 15/54* (2006.01)

(52) U.S. Cl.
USPC ..... 135/120.1; 135/115; 135/901

(58) Field of Classification Search
CPC ..... E04H 15/001; E04H 15/54; E04H 15/64; E04H 15/32
USPC ..... 135/901, 115, 120.1; 43/1
See application file for complete search history.

(56) References Cited

U.S. PATENT DOCUMENTS 2,159,273 A * 5/1939 Killinger ..... 135/125
2,816,297 A * 12/1957 Stanley ..... 114/351
2,827,729 A * 3/1958 Hoene ..... 43/1
4,473,087 A 9/1984 Cavender
4,900,204 A * 2/1990 Summers ..... 410/97
5,477,875 A * 12/1995 Daly, Jr. ..... 135/95
5,762,085 A 6/1998 Punch
5,989,656 A * 11/1999 Soloman ..... 428/17
6,021,794 A 2/2000 Guerra
6,668,749 B2 * 12/2003 Fargason ..... 114/351
7,040,333 B1 * 5/2006 Ransom et al. ..... 135/126
7,475,699 B2 1/2009 Johnson et al.
7,565,909 B2 * 7/2009 Reis et al. ..... 135/115
7,650,899 B2 * 1/2010 Eastman et al. ..... 135/120.1
2002/0069904 A1 6/2002 Robinson
2006/0096630 A1 * 5/2006 Eastman et al. ..... 135/115
2006/0207641 A1 * 9/2006 Reis et al. ..... 135/87
2010/0229906 A1 * 9/2010 Putman ..... 135/96
2010/0269876 A1 * 10/2010 Schlipf ..... 135/143
2011/0126873 A1 * 6/2011 Desouches et al. ..... 135/121

* cited by examiner

*Primary Examiner* — David R Dunn
*Assistant Examiner* — Danielle Jackson
(74) *Attorney, Agent, or Firm* — Holland & Hart

(57) ABSTRACT

A ground blind assembly includes a blind and a resilient attachment member. The blind includes a resilient cover mounted on a collapsible support structure. The blind has at least one sidewall and a top. The resilient attachment member is releasably mounted to the blind and covers at least a portion of the ground blind. The resilient attachment member is configured to releasably secure at least one object to the blind to camouflage the blind.

24 Claims, 6 Drawing Sheets

BRUSH-IN APPARATUS FOR BLINDS

TECHNICAL FIELD

The present disclosure is directed to portable binds for use by sportsmen, and more particularly relates to apparatuses and methods for securing objects simulating natural growth to portable and collapsible blinds.

BACKGROUND

Hunters, photographers, bird watchers, etc. ("sportsman") often desire or have a need to remain hidden from view of wildlife they are observing or pursuing. Portable shelters or blinds ("blind" or "blinds") are commonly used to hide the sportsman from view. Blinds may be collapsible. Blinds typically include camouflage fabric that simulates the appearance of at least some of the local environment. Wildlife may be startled by foreign objects, such as blinds, that have not traditionally been present in a given location where wildlife animals are used to frequenting (e.g., a water hole or a game trail). Camouflaging a blind may, however, reduce the "unnatural" appearance of a blind and reduce its startle effect on wildlife animals.

One way to camouflage a blind may be to position objects on or around the blind to cover it at least partially. This adds an extra dimension to the blind. Sportsmen sometimes lean objects such as branches against a sidewall or on top of the blind to add camouflage to the blind. This may be referred to as "brushing in" the blind. However, wind and other weather conditions may move the objects, and may cause additional noise when the objects move and rub against the blind material, which draws attention to the blind rather than camouflaging it.

Opportunities exist for improvements in camouflaging blinds.

SUMMARY

One aspect of the present disclosure relates to a blind assembly that includes a blind and a resilient attachment member. The ground blind includes a cover mounted on a collapsible support structure. The ground blind has at least one sidewall and a top. The resilient attachment member is releasably mounted to the ground blind and covers at least a portion of the top of the ground blind. The resilient attachment member is configured to releasably secure at least one object to the ground blind to camouflage the blind.

The resilient attachment member may include a flexible border member extending continuously around the perimeter of the resilient attachment member. The resilient attachment member may also include a plurality of flexible cross-members attached to the flexible border member that overlap each other. The resilient attachment member may be constructed as a net having at least one elastic portion. The resilient attachment member may be configured to extend over an entire top of the ground blind and around a perimeter of the ground blind that is defined by at least one sidewall.

The at least one object may include at least one of a branch, grass, and leaves. The resilient attachment member may have a plurality of perimeter members defining a square-shaped perimeter, and a plurality of cross-members extending between the plurality of perimeter members. The resilient attachment member may include a plurality of connectors configured to releasably secure the resilient attachment member to the ground blind. The resilient attachment member may be configured for use with a plurality of different shapes and sizes of the blind.

Another aspect of the present disclosure relates to a method of attaching objects to an outer surface of a ground blind. The method includes providing a collapsible ground blind and an attachment member, wherein the ground blind includes a flexible cover defining an outer surface of the ground blind. The method includes releasably mounting the attachment member to the outer surface of the ground blind, and inserting at least one object between the attachment member and the outer surface of the ground blind. The at least one object simulates natural vegetation.

Releasably mounting an attachment member may include elastically deforming a portion of the attachment member. Releasably mounting an attachment member may include wrapping a portion of the attachment member around a portion of the ground blind. The ground blind may include a top and a sidewall, wherein the sidewall extends downward from the top and defines a periphery of the ground blind. Releasably mounting the attachment member to the outer surface of the ground blind may include extending the attachment member around the periphery of the ground blind. The ground blind may include a top and a sidewall extending downward from the top, and releasably mounting the attachment member to the outer surface of the ground blind may include extending a portion of the attachment member over the top of the ground blind.

A further aspect of the present disclosure relates to a method of camouflaging a ground blind. The method includes providing a collapsible ground blind and a resilient attachment member, wherein the resilient attachment member has at least one elastic portion. The method includes setting up the ground blind in an expanded position, wherein the ground blind has a top and at least one sidewall. The method also includes releasably mounting the resilient attachment member to the ground blind, wherein the resilient attachment member extends over at least a portion of the top of the ground blind, and inserting an object between the resilient attachment member and the top of the ground blind, wherein the object simulates natural vegetation.

The step of inserting an object may include inserting a plurality of objects between the resilient attachment member and the top of the ground blind, wherein each of the objects simulates natural vegetation. The resilient attachment member may include multiple elongate elastic members, and inserting an object between the resilient attachment member and the top of the ground blind may include inserting the object between at least one of the elastic members and the top of the ground blind.

Releasably mounting the resilient attachment member to the ground blind may include extending a portion of the resilient attachment member around at least a portion of at least one sidewall. The resilient attachment member may include an elastic border and a plurality of elastic cross-members, wherein the elastic border defines a perimeter of the resilient attachment member, and the plurality of elastic cross-members are connected to the border. Inserting an object between the resilient attachment member and the top of the ground blind may include positioning the object between the top of the ground blind and at least one of the border and cross-members. The ground blind may include a flexible cover mounted on a collapsible support frame, wherein the support structure defines a plurality of corners at an intersection between the top and at least one sidewall of the ground blind, and releasably mounting the resilient attachment member to the ground blind includes extending the resilient attachment member around at least two of the corners.

The resilient attachment member may include a plurality of connectors mounted around a perimeter edge of the resilient attachment member, and releasably mounting the resilient attachment member to the ground blind may include releasably connecting the plurality of connectors to the ground blind. The plurality of connectors may include at least one hook member, and the ground blind may include at least one loop member, and releasably mounting the resilient attachment member to the ground blind may include inserting a portion of the at least one hook member in the at least one loop member.

BRIEF DESCRIPTION OF THE DRAWINGS

The accompanying drawings illustrate a number of embodiments of the instant disclosure and are part of the specification. Together with the following description, the drawings demonstrate and explain principles of the instant disclosure.

Figure 1:
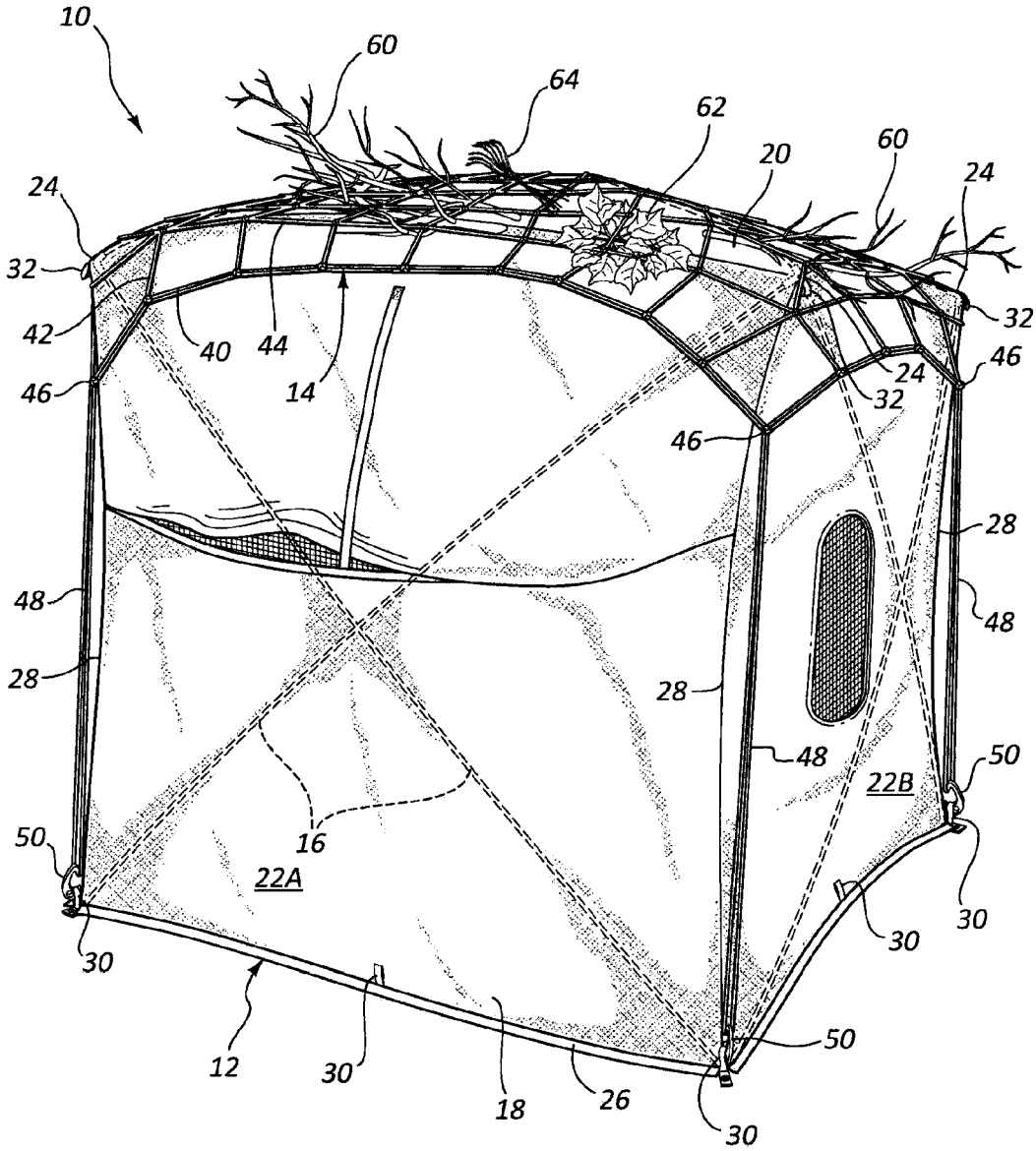
FIG. 1 is a perspective view of a ground blind assembly in a first arrangement in accordance with the present disclosure.

Throughout the drawings identical reference characters and descriptions indicate similar, but not necessarily identical, elements. While embodiments of the instant disclosure are susceptible to various modifications and alternative forms, specific embodiments have been shown by way of example in the drawings and will be described in detail herein. However, one of skill in the art will understand that embodiments of the instant disclosure are not intended to be limited to the particular forms disclosed herein. Rather, the instant disclosure covers all modifications, equivalents, and alternatives falling within the scope of embodiments defined by the appended claims.

DETAILED DESCRIPTION

The present disclosure is directed to blind assemblies, including ground blinds, blind attachment features, structures used to connect objects to blinds, and related methods. One aspect of the present disclosure is directed to a blind assembly that includes a ground blind and a resilient attachment member that is removably mounted to the ground blind. The resilient attachment member is configured to help mount or retain an object on an outer surface of the ground blind, wherein the object may constitute natural vegetation such as, for example, branches, leaves, grass stems, and brush. The object may be a live or natural vegetation or may be a synthetic object formed to look like natural vegetation. Covering a ground blind with such objects is typically referred to as "brushing-in" or camouflaging a ground blind.

The resilient attachment member may comprise at least one elastic portion such as an elastic cord that extends around and defines a perimeter of the resilient attachment member. The resilient attachment member may include a plurality of cross-members such as elastic cords, strings, or straps that extend between perimeter members of the resilient attachment member. The cross-members may form a matrix, or crosshatched pattern of the resilient attachment member. The crosshatched pattern may include a plurality of openings through which the camouflage objects may be inserted and retained by the resilient attachment member.

In one arrangement, the resilient attachment member is positioned across a top portion of the blind and attached to the blind at locations vertically below the top surface of the blind. The blind may be on the ground, on a platform, or in a tree. The blind may be portable. The blind may include a plurality of elastic cords and attachment connectors that are used to secure the resilient attachment member to the blind. In another arrangement, the resilient attachment member extends over and covers at least a portion of one of the sidewalls of the blind. The resilient attachment member may extend to cover portions of multiple sidewalls and extend around at least a portion of an outer periphery of the ground blind defined by a plurality of sidewalls or side panels of the ground blind.

The resilient attachment member may be sized and configured for attachment to many different types and sizes of blinds. For example, a single sized resilient attachment member may be used with blinds of different shapes and sizes. The resilient properties of the blind (e.g., the use of elastic cords or the resilient material used for the cross-members) may permit the user to stretch the resilient attachment member over blinds of different shapes and sizes and connect the resilient attachment member at various locations on the blind or to objects in proximity to the blind (e.g., a tree or brush). The resilient attachment member may be referred to as a "one size fits all" attachment member or brush-in apparatus for blinds. In some arrangements, a particular size, shape or configuration of resilient attachment member may be configured for use with a given type or class of blinds that includes multiple different blinds. The ability to use one resilient attachment member for multiple different blind constructions may reduce manufacturing, storage, handling and other costs.

Figure 2:
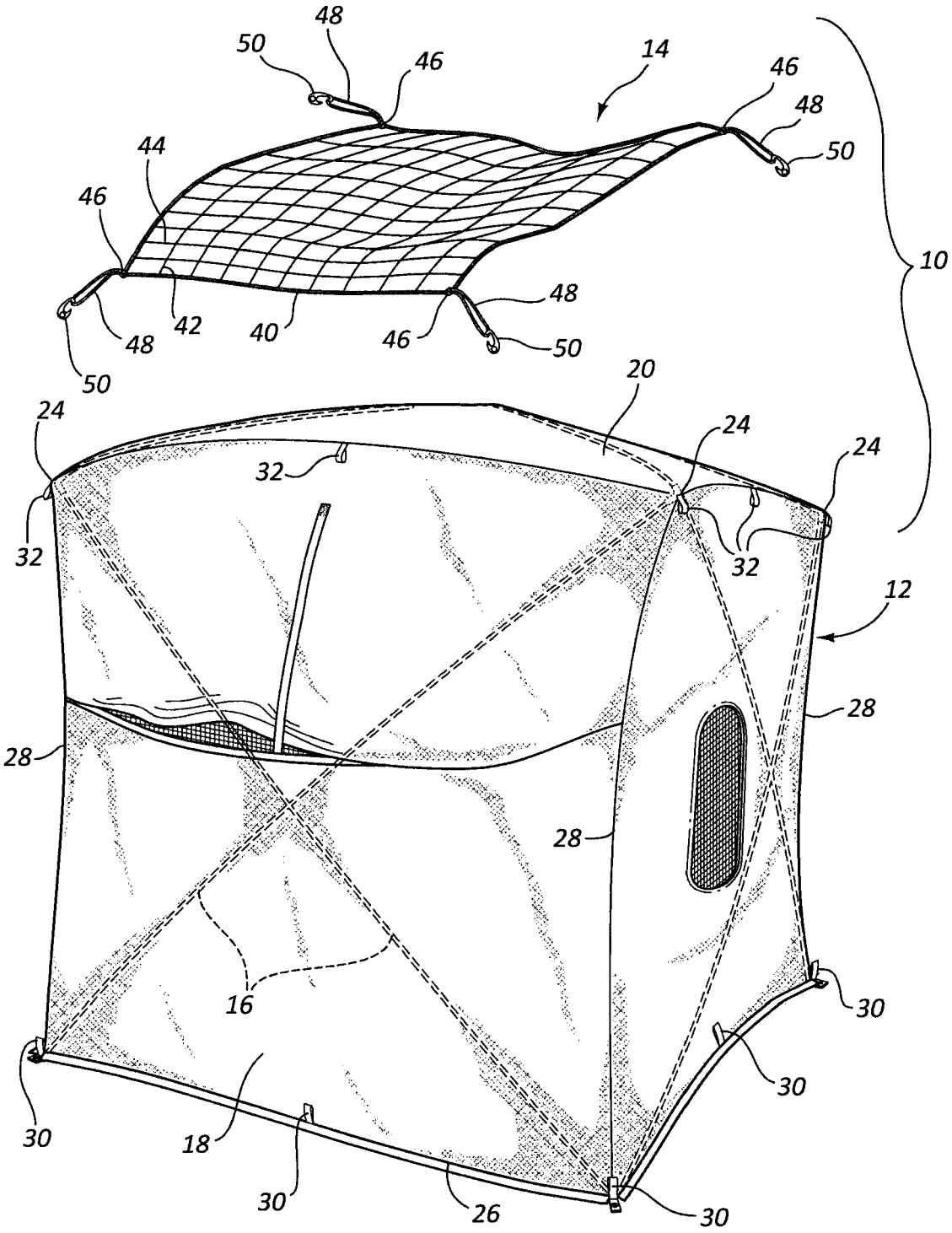
FIG. 2 is an exploded perspective view of the ground blind assembly of FIG. 1.

Referring to FIGS. 1 and 2, an example blind, in the form of a ground assembly 10, is shown and described. It is to be understood that the present invention may be used on any type of blind, portable or stationary, whether on the ground or elevated in some way.

The ground blind assembly 10 may be a collapsible ground blind 12 and a resilient attachment member 14. The ground blind 12 may be a portable ground blind that can be moved to different locations. The ground blind 12 may be collapsible from an expanded or extended position that maximizes an interior space for a sportsman to reside (see FIG. 1), to a collapsed or retracted position to provide ease of transport of the ground blind 12.

The ground blind 12 may include a collapsible support structure 16 and a flexible cover 18. The collapsible support structure 16 may at least partially define corners, sidewalls, and top or roof portions of the ground blind 12 when in the expanded position shown in FIGS. 1 and 2.

The ground blind 12 may also include a top 20, a plurality of sidewalls 22A-B, a plurality of top corners 24, a bottom edge 26, a plurality of side edges 28, and a plurality of top and bottom blind connectors 30, 32. The sidewalls 22A-B extend vertically downward from the top 20. The ground blind 12 may include three or more sidewalls 22A-B arranged around a periphery of the ground blind 12. The top corners 24 are defined at an intersection between the top 20 and sidewalls 22A-B. The side edges 28 define an intersection between adjacent sidewalls 22A-B. The bottom blind connectors 30 may be positioned along the bottom edge 26. In some arrangements, a plurality of top connector 32 are positioned at other locations on the ground blind 12 vertically above the bottom edge 26, such as at the top corner 24 or along any of the side edges 28. Typically, the ground blind 12 includes connectors only along the bottom edge 26 to avoid compromising the integrity of the flexible cover 18 where the connectors are permanently mounted, wherein the attachment point may provide weakness in the flexible cover 18 or hinder water resistant properties of the flexible cover 18.

The resilient attachment member 14 may be stretchable and/or flexible, and may include a border member 40, a plurality of first cross-members 42, and a plurality of second cross-members 44. The border member 40 and first and second cross-members 42, 44 may include a plurality of elongate elastic members. The resilient attachment member 14 may define a plurality of corners 46 around a periphery of the resilient attachment member 14. The embodiment of FIGS. 1 and 2 illustrates a rectangular-shaped resilient attachment member 14 with four corners 46 and a periphery defined by the border member 40. The border member 40 includes four segments defined between each of the corners 46. The border member 40 may be continuous, single piece member, or may include a plurality of separate segments that are assembled together.

In some arrangements, the resilient attachment member 14 may include only first cross-members 42 or only second cross-members 44 in addition to the border member 40. In some arrangements, at least one of the first and second cross-members 42, 44 define a portion of the border member 40. In other arrangements, the first and second cross-members 42, 44 may extend diagonally rather than perpendicularly relative to the border member 40. Additionally, various other types and configurations of cross-members may be provided to create any type of matrix or structure to create a resilient retention system. In still further arrangements, additional sets of cross-members may be included with the resilient attachment member 14 and extend between the border member 40 in alternative angled orientations from the arrangement of the first and second cross-members 42, 44.

The border member 40 and first and second cross-members 42, 44 may each comprise elastic material, rubber material, stretch fabric, or any other desired resilient material. In some arrangements, at least portions of the border member 40 and first and second cross-members 42, 44 may comprise an inelastic material. The resilient attachment member 14 may comprise various materials that provide, for example, flexibility, elasticity, wear resistance, strength, durability and other desired properties. Some example materials for use in the resilient attachment member 14 include, for example, elastic cords, bungi cords, shock cords, or any resilient or flexible cord-type material.

Figure 3:
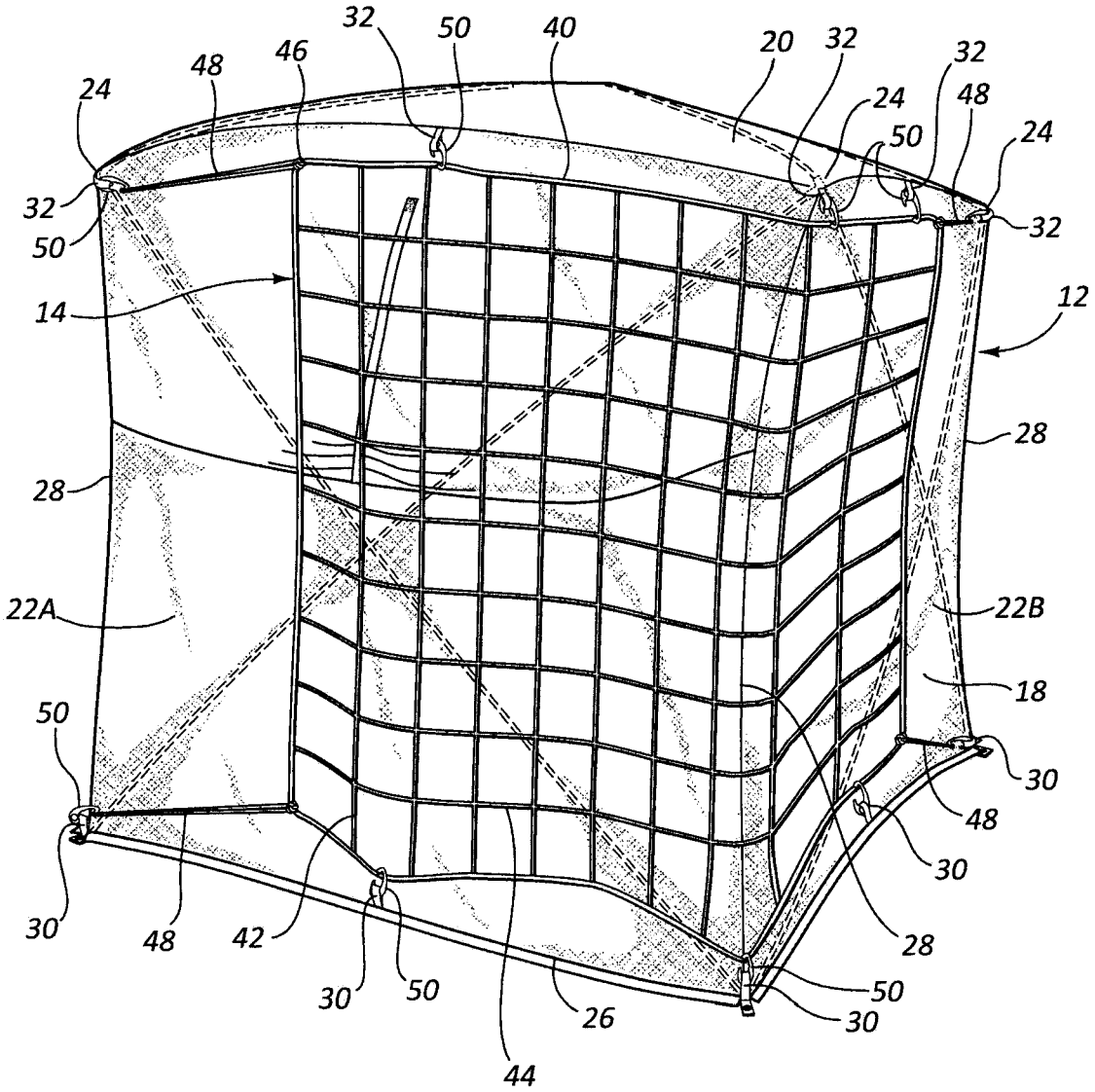
FIG. 3 is a perspective view of the ground blind assembly of FIG. 1 in a second arrangement.
Figure 4:
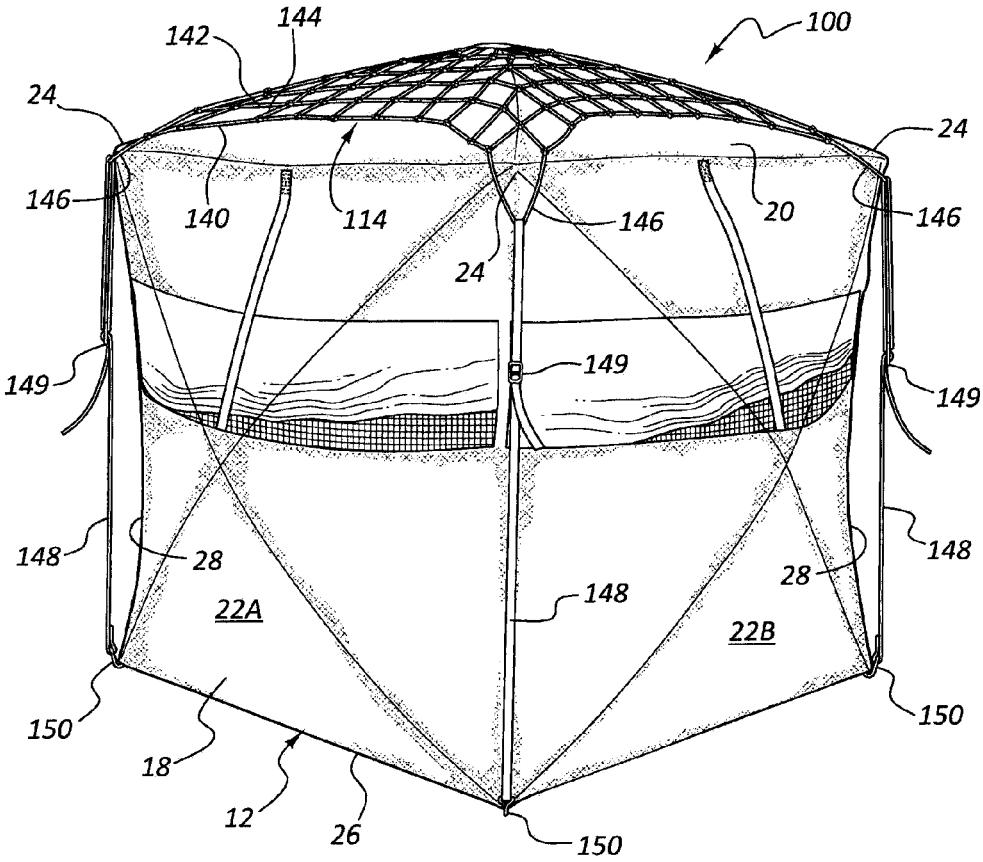
FIG. 4 is a top view of another ground blind assembly in accordance with the present disclosure.

In some arrangements, the resilient attachment member 14 may have sufficient elastic properties to remain releasably mounted to the ground blind 12 without the use of further attachment structures. For example, portions of the resilient attachment member 14 may be stretched over the top or corners of the ground blind 12 to provide a releasable attachment to the ground blind 12 without further attachment structures (e.g., attachment connectors 50). In other arrangements, a plurality of attachment connectors 50 may be used to connect the resilient attachment member 14 to the ground blind with a releasably attachment. As shown in FIGS. 1, 3 and 4, the resilient attachment member 14 is mounted only to the ground blind 12. The attachment connectors 50 may be constructed as, for example, clips, brackets, buckles, hooks, cords, loops, buttons, snaps, straps, or other features that interface with corresponding features on the ground blind 12 to provide the desired connection. The attachment connectors 50 shown in FIG. 2 are shaped as hooks that connect with loop-shaped bottom blind connectors 30 on the ground blind 12. The attachment connectors 50 may be attached to straps or cords 48 that extend from the resilient attachment member 14. The cords 48 may extend from, for example, at least one of the corners 46 and the border member 40 of the resilient attachment member 14. The cords 48 may have elastic properties to provide a variable length to position the attachment connectors 50 at different locations on the ground blind 12 to connect to the top and bottom blind connectors 30, 32.

The resilient attachment member 14 may be arranged extending over portions of the top 20 of the ground blind 12 as shown in FIG. 1. Portions of the resilient attachment member 14 may extend over the top corners 24 to provide further positioning or releasable attachment of the resilient attachment member 14 to the ground blind 12. Extending the resilient attachment member 14 over the top corners 24 may include wrapping portions of the border member 40 or the first or second cross-members 42, 44 over the top corners 24 to help retain the resilient attachment member 14 in a given arrangement relative to the ground blind 12. In some arrangements, the resilient attachment member 14 may extend around or over only portions of the top 20 and may further extend along portions of the sidewalls 22A-B. The resilient attachment member 14 may extend around an entire periphery or substantially all of a periphery of the ground blind 12 defined by the plurality of sidewalls 22A-B.

A user of the ground blind assembly 10 may attach objects to the ground blind 12 once the resilient attachment member 14 is properly releaseably secured to the ground blind 12. Example objects that may be attached to the ground blind 12 using the resilient attachment member 14 include, for example, branches 60, leaves 62, and grass 64. The objects 60, 62, 64 may be inserted through portion of the resilient attachment member 14 into a position where a portion of each object is arranged between the ground blind 12 and the resilient attachment member 14. The objects 60, 62, 64 may be held in a place by at least one of the border member 40 and first and second cross-members 42, 44. The elastic properties of the resilient attachment member 14 may permit the user to adjust portions of the resilient attachment member 14 into different positions while inserting the objects 60, 62, 64 into a desired location relative to the ground blind 12. After the objects are positioned by the user, the user may physically let go of resilient attachment member 14 so that the elastic properties of the resilient attachment member 14 apply a force against the objects 60, 62, 64 to hold the objects against the ground blind 12. In some arrangements, the user may use tightening features on the resilient attachment member 14 (e.g., adjustable buckles or straps) to apply additional tension in the resilient attachment member 14 to hold the objects 60, 62, 64 against the ground blind 12.

The resilient attachment member 14 may be used to secure a plurality of objects to the ground blind 12. The objects may be positioned along the top 20 and sidewalls 22A-B or at any location along an outer surface defined by the flexible cover 18 of the ground blind 12. The objects 60, 62, 64 may be at least partially supported on a ground surface upon which the ground blind assembly 10 is supported while also being at least partially retained against the ground blind 12 with the resilient attachment member 14.

The resilient attachment member 14 may be secured to the ground blind 12 in various orientations relative to the top 20 and sidewalls 22A-B. FIG. 3 illustrates an arrangement of the resilient attachment member 14 extending along sidewalls 22A-B and spanning at least one side edge 28. The attachment connectors 50 of the resilient attachment member 14 may be connected to both bottom and top blind connectors 30, 32. In other arrangements, all of the attachment connectors 50 may connected to bottom blind connectors 30. A portion of the resilient attachment member 14 may extend over at least one of the top corners 24 of the ground blind 12 to help retain the resilient attachment member 14 in a vertical position at least partially overlapping a portion of the top 20.

A plurality of resilient attachment members 14 may be used to cover different portions of a ground blind. In one example, first and second resilient attachment members 14 are used to cover different portions of the top 20 and sidewalls 22A-B and other features along an outer surface of the ground blind 12. The resilient attachment member 14 may be sized to extend completely over at least one of the sidewalls of the ground blind 12. In some configurations, the resilient attachment member 14 may cover substantial portions of an outer surface of the ground blind 12 such as, for example, the entire top 20 and at least half of each of the sidewalls 22A-B, or substantially all of a periphery of the ground blind defined by the sidewalls 22A-B and at least portions of the top 20.

Some embodiments of the resilient attachment member 14 may include large openings between first cross-members 42 and/or second cross-members 44. These enlarged spaces between adjacent first and second cross-members 42, 44 may overlap with a window or door feature of the ground blind 12 so as not to interfere with the sportman's access into or out of the ground blind 12.

In some arrangements, the first and second cross-members 42, 44 may be secured together at intersections where the first and second cross-members 42, 44 overlap. In one example, a sliding connection is provided between overlapping first and second cross-members 42, 44. In other arrangements, a permanent connection is provided between the first and second cross-members 42, 44 at an intersection therebetween. In still further arrangements, the first and second cross-members 42, 44 overlap in a crisscross pattern without a connection therebetween that provides the user the ability to customize an opening size or space between adjacent first and second cross-members 42, 44.

Figure 5:
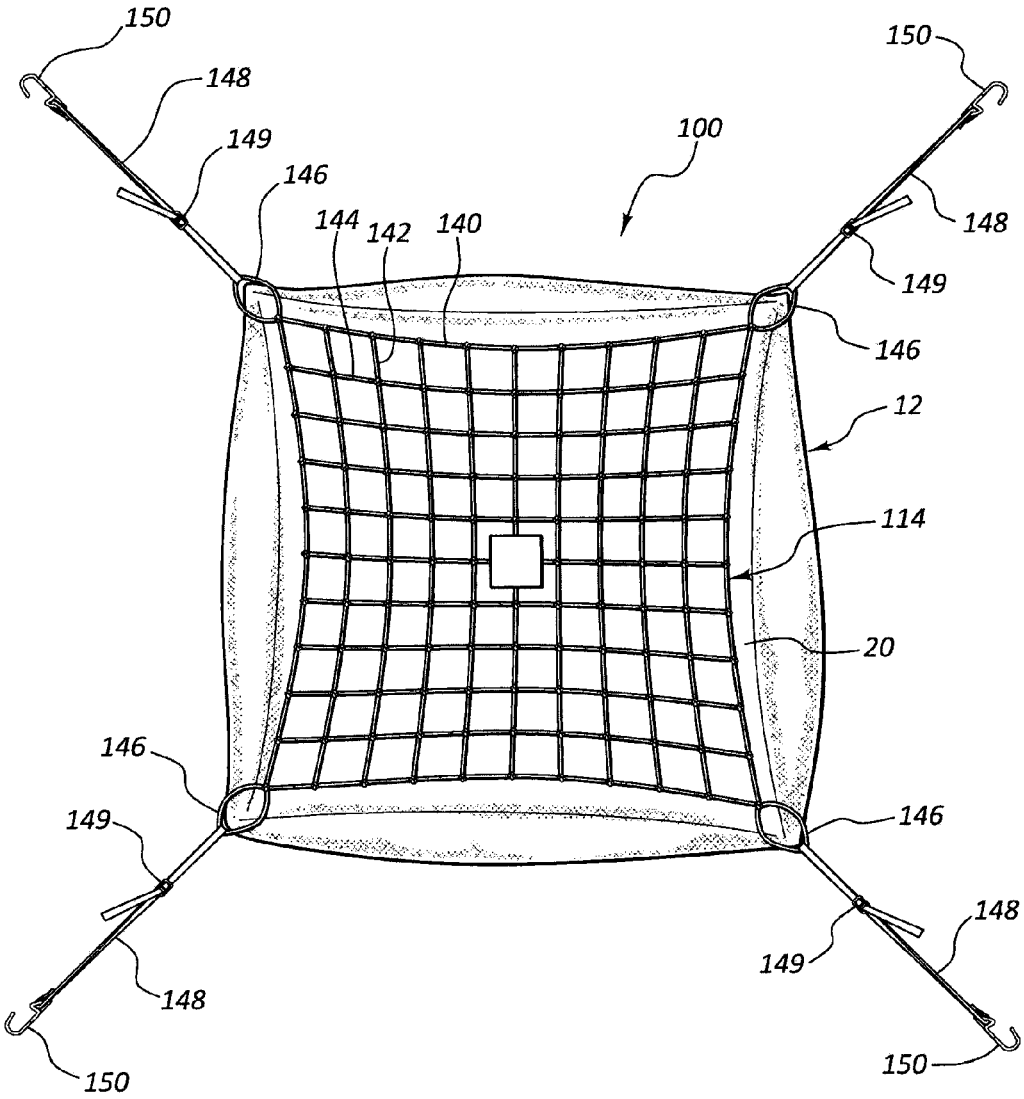
FIG. 5 is a perspective view of the ground blind assembly of FIG. 4.

Referring now to FIGS. 4-5, another example ground blind assembly 100 is shown and described. The ground blind assembly 100 includes a collapsible ground blind 12 and a resilient attachment member 114. The ground blind 12 may have the same or similar features as described above with reference to FIGS. 1-3.

The resilient attachment member 114 may include a border member 140, a plurality of first cross-members 142, and a plurality of second cross-members 144. The border member 40 and the first and second cross-members 142, 144 may each include a plurality of elongate elastic members. The resilient attachment member 114 may define a plurality of corner members 146 around a periphery of the resilient attachment member 114. The embodiment of FIGS. 4-5 illustrates a rectangular-shaped resilient attachment member 114 with four corner members 146 and a periphery defined by the border member 140. The border member 140 includes four segments with one segment extending between each of the corner members 146. The border member 140 may be continuous, single piece member, or may include a plurality of separate segments that are assembled together.

In some arrangements, the resilient attachment member 114 may include only first cross-members 142 or only second cross-members 144 in addition to the border member 140. In some arrangements, at least one of the first and second cross-members 142, 144 define a portion of the border member 140. In other arrangements, the first and second cross-members 142, 144 may extend diagonally rather than perpendicularly or parallel relative to the border member 140. In still further arrangements, additional sets of cross-members may be included with the resilient attachment member 114 and extend between portions of the border member 140 in alternative angled orientations from the arrangement of the first and second cross-members 142, 144 shown in the figures.

The border member 140 and first and second cross-members 142, 144 may each comprise elastic material. In some arrangements, at least portions of the border member 140 and first and second cross-members 142, 144 may comprise an inelastic material. The resilient attachment member 114 may comprise various materials that provide, for example, flexibility, elasticity, wear resistance, strength, durability and other desired properties. Some example materials for use in the resilient attachment member 114 include, for example, elastic cords, bungi cords, shock cords, or any resilient or flexible cord-type material.

In some arrangements, the resilient attachment member 114 may have sufficient elastic properties to remain releasably mounted to the ground blind 12 without the use of further attachment structures. In other arrangements, a plurality of attachment connectors 150 may be used to connect the resilient attachment member 114 to the ground blind with a releasably attachment. The attachment connectors 150 may be constructed as, for example, clips, brackets, buckles, hooks, cords or straps, or other connecting features that interface with the ground blind 12. The attachment connectors 150 shown in FIGS. 4-5 are shaped as hooks that connect along a bottom edge 26 of the ground blind 12.

The attachment connectors 150 may be attached to straps or cords 148 that extend from the resilient attachment member 14. The straps 148 may extend from, for example, at least one of the corner members 146 and/or the border member 140 of the resilient attachment member 114. The straps 148 may have elastic properties to provide a variable length to position the attachment connectors 150 at different locations on the ground blind 12. In other arrangements, the straps 148 are relatively inelastic and are adjustable in length using at least one buckle member 149 or other length adjustment feature.

The resilient attachment member 114 may be arranged extending over portions of the top 20 of the ground blind 12 as shown in FIGS. 4-5. The corner members 146 of the resilient attachment member 114 may extend over or around the top corners 24 to help maintain a position of the resilient attachment member 114 on the ground blind 12. The corner members 146 may be sized and oriented to align with and extend around the top corners 24. In some arrangements, the resilient attachment member 114 may be positioned entirely within a periphery of the top 20 of the ground blind 12 as shown in FIG. 5, expect for portions of the corner members 146 and the straps 148 that carry the buckle members 149 and attachment connects 150.

While a rectangular-shape resilient attachment member 14, 114 is shown in the figures, other shapes and sizes are possible. In one example, the resilient attachment member 14, 114 has a circular-shape periphery, while other arrangements include oval, triangular, or hexagonal shaped peripheries.

Figure 6:
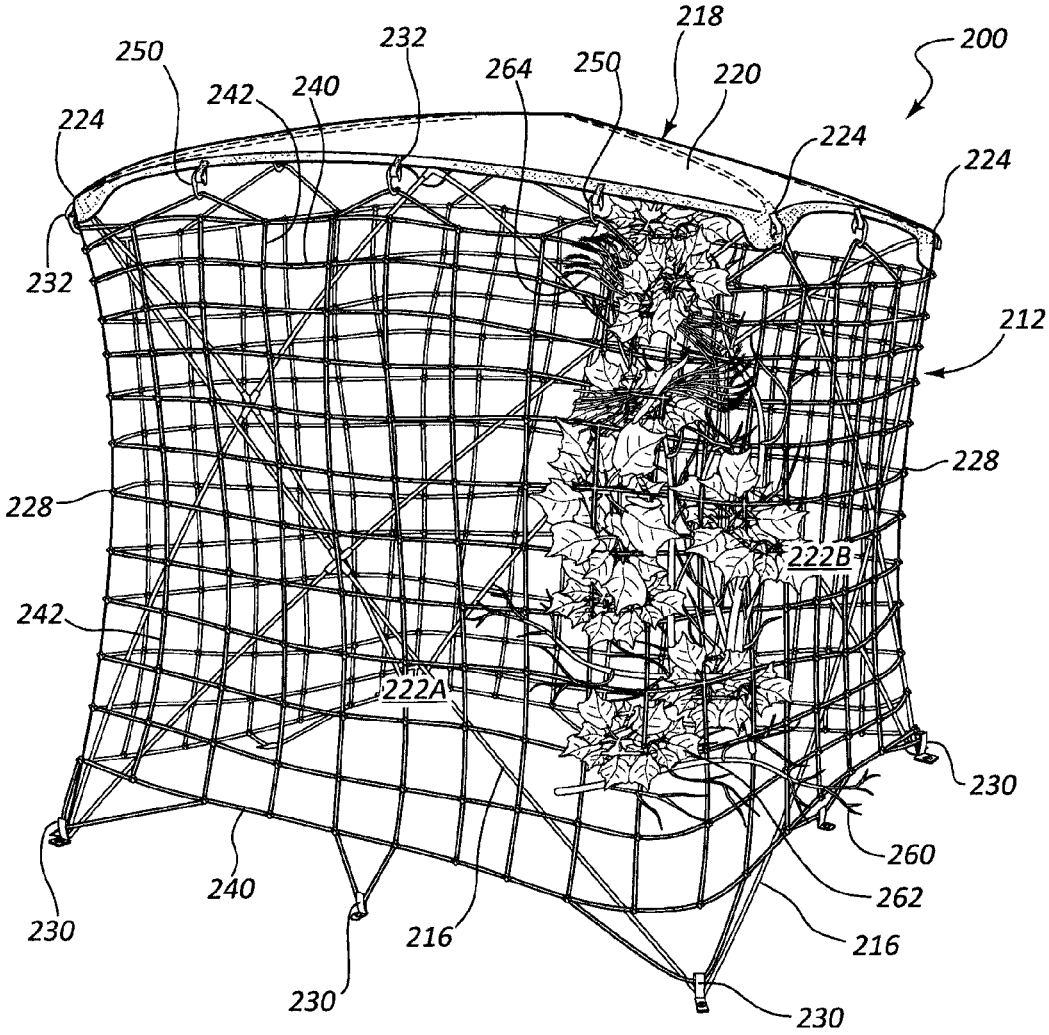
FIG. 6 is a perspective view of another ground blind assembly in accordance with the present disclosure.

Referring now to FIG. 6, another example ground blind assembly 200 is shown and described. The ground blind assembly 200 includes a ground blind 212. The ground blind 212 may include features of the resilient attachment members 14, 114 integrated into the ground blind 212 or used to replace portions of the collapsible ground blind 212.

The ground blind 212 may include a collapsible support structure 216 and a flexible cover 218. The collapsible support structure 216 may at least partially define corners, sidewalls, and top or roof portions of the ground blind 212 when in the expanded position shown in FIG. 6. The flexible cover 218 may extend over and cover at least portions of the collapsible support structure 216.

The ground blind 212 may include a top 220, a plurality of sidewalls 222A-B, a plurality of top corners 224, a plurality of side edges 228, and a plurality of top and bottom blind connectors 230, 232. The ground blind 212 may include three or more sidewalls 222A-B arranged around a periphery of the ground blind 212. At least one of the sidewalls 222A-B may include features of the resilient attachment member 14, 114 described above, including, for example, a border member 240, a plurality of first cross-members 242, and a plurality of second cross-members 244. The border member 240 and the first and second cross-members 242, 244 may each include a plurality of elongate elastic members. The border member 240 and first and second cross-members 242, 244 may include elastic material, rubber material, stretch fabric, or any other desired resilient material.

In some arrangements, the sidewalls 22A-B may be connected to the top 220 and to the collapsible support structure 216. In one embodiment, the border member 240 is releasably connected to the blind connectors 232 along a bottom edge of the top 220 using a plurality of attachment connectors 250. In other arrangements, the sidewalls 22A-B are permanently connected to the top 220. In some arrangements, at least one of the sidewalls 222A-B comprises a fabric material (e.g., see sidewall 22A of FIG. 1) and defines a door opening or window opening into the ground blind 212.

A user of the ground blind assembly 200 may attach objects to the ground blind 212 using any of the border member 240 and first and second cross-members 242, 244. Example objects that may be attached to the ground blind 212 include, for example, branches 260, leaves 262, and grass 264. The objects 260, 262, 264 may be held in a place by at least one of the border member 240 and first and second cross-members 242, 244. The entire periphery of the ground blind 212 may have objects 260, 262, 264 attached thereto. In some arrangements, the top 220 may also include a plurality of border members 240 and first and second cross-members 242, 244 so that the top 220 as well as the sidewalls 222A-B have objects 260, 262, 264 attached thereto.

The term "ground blind" is used throughout to reference the structure to which the resilient attachment member is mounted. Other types of enclosures may benefit from the advantages provided by the example resilient attachment members disclosed herein. For example, the resilient attachment member may be mounted to other types of blinds, tree stands, and structures used by sportsmen to at least partially hide the sportsman from view in the wild.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive, and that reference be made to the appended claims and their equivalents for determining the scope of the instant disclosure. In addition, for ease of use, the words "including" and "having," as used in the specification and claims, are interchangeable with and have the same meaning as the word "comprising."

What is claimed is:

1. A blind assembly, comprising:

a blind having a cover mounted on a collapsible support structure, the ground blind having at least one outer surface defined by the cover;

a resilient attachment member comprising an elastic net matrix, the resilient attachment member being completely separable from and releasably mounted only to the blind, the resilient attachment member being resiliently stretched across and overlaid against the outer surface defined by the cover, the resilient attachment member being configured to releasably secure at least one object between the blind and the resilient attachment member to camouflage the blind.

2. The blind assembly of claim 1, wherein the resilient attachment member comprises a flexible border member extending continuously around a perimeter of the resilient attachment member, and a plurality of flexible cross-members attached to the flexible border member and overlapping each other.

3. The blind assembly of claim 1, wherein the resilient attachment member is configured to extend over an entire top of the blind and around a perimeter of the blind defined by at least one sidewall.

4. The blind assembly of claim 1, wherein the at least one object includes at least one of branches, grass, and leaves.

5. The blind assembly of claim 1, wherein the resilient attachment member has a plurality of perimeter members defining a square shaped perimeter and a plurality of cross-members extending between the plurality of perimeter members.

6. The blind assembly of claim 1, wherein the resilient attachment member includes a plurality of connectors configured to releasably secure the resilient attachment member to the ground blind.

7. The blind assembly of claim 1, wherein the resilient attachment member is configured for use with a plurality of different shapes and sizes of the blind.

8. The blind assembly of claim 1, wherein the resilient attachment member defines at least a portion of the cover.

9. The blind assembly of claim 1, wherein the resilient attachment member is configured to releasably secure the at least one object directly to the outer surface of the blind.

10. A method of attaching objects to an outer surface of a blind, comprising:

providing a blind and an attachment member, the blind having a cover defining an outer surface of the blind, the attachment member having a plurality of corners and comprising an elastic net matrix;

releasably mounting the attachment member to the blind at every corner of the attachment member, the attachment member being overlaid across and against the outer surface;

inserting at least one object between the attachment member and the outer surface of the blind to be in contact with the outer surface of the blind, the at least one object camouflaging the blind.

11. The method of claim 10, wherein releasably mounting the attachment member includes elastically deforming a portion of the attachment member.

12. The method of claim 10, wherein releasably mounting the attachment member includes wrapping a portion of the attachment member around a portion of the blind.

13. The method of claim 10, wherein the blind includes a top and a sidewall extending downward from the top and defining a periphery of the blind, and releasably mounting the attachment member to the outer surface of the blind includes extending the attachment member around the periphery of the blind.

14. The method of claim 10, wherein the blind includes a top and a sidewall extending downward from the top, and releasably mounting the attachment member to the outer surface of the blind includes extending a portion of the attachment member over the top of the blind.

15. The method of claim 10, further comprising mounting the attachment member only to the blind.

16. A method of camouflaging a ground blind, comprising:

providing a collapsible ground blind and a resilient attachment member, the resilient attachment member having at least one elastic net matrix portion and a plurality of corners;

setting up the ground blind in an expanded position, the ground blind having a top and at least one side;

releasably mounting the resilient attachment member only to the ground blind at each corner of the resilient attachment member, the resilient attachment member extending across and against at least a portion of the top of the ground blind;

inserting an object between the resilient attachment member and the top of the ground blind, the object simulating a natural environment.

17. The method of claim 16, wherein inserting an object between the resilient attachment member and the top of the ground blind includes inserting a plurality of objects between the resilient attachment member and the top of the ground blind, wherein each object simulates natural vegetation.

18. The method of claim 16, wherein the resilient attachment member includes multiple elongate elastic members, and inserting an object between the resilient attachment member and the top of the ground blind includes inserting the object between at least two of the elongate elastic members and the top of the ground blind.

19. The method of claim 16, wherein releasably mounting the resilient attachment member to the ground blind includes extending a portion of the resilient attachment member around at least a portion of the at least one side.

20. The method of claim 19, wherein the resilient attachment member includes an elastic border that defines a perimeter of the resilient attachment member, and a plurality of elastic cross-members connected to the elastic border, and inserting an object between the resilient attachment member and the top of the ground blind includes positioning the object between at least one of the elastic border and cross-members and the top of the ground blind.

21. The method of claim 16, wherein the ground blind includes a flexible cover mounted on a collapsible support structure, the collapsible support structure defining a plurality of corners at an intersection between the top and at least one sidewall of the ground blind, and releasably mounting the resilient attachment member to the ground blind includes extending the resilient attachment member around at least two of the corners.

22. The method of claim 16, wherein the resilient attachment member includes a plurality of connectors mounted around a perimeter edge of the resilient attachment member, and releasably mounting the resilient attachment member to the ground blind includes releasably connecting the plurality of connectors to the ground blind.

23. The method of claim 22, wherein the plurality of connectors includes at least one hook member, and the ground blind includes at least one loop member, and releasably mounting the resilient attachment member to the ground blind includes inserting a portion of the at least one hook member in the at least one loop member.

24. The method of claim 16, wherein the resilient attachment member holds the object in contact with an outer surface of the ground blind.

* * * * *